US006126699A

United States Patent [19]

McCurley

[11] Patent Number: 6,126,699

[45] Date of Patent: Oct. 3, 2000

[54] SUBLIMATION PRINTING OF WOODEN ARTICLES

[76] Inventor: Avery Lee McCurley, Rte. 1, Box 18-D, Eastanollee, Ga. 30538

[21] Appl. No.: 09/342,520

[22] Filed: Jun. 29, 1999

[51] Int. Cl.[7] ..... D06P 5/30; B05D 5/04

[52] U.S. Cl. ..... 8/471; 427/261; 427/397

[58] Field of Search ..... 8/471; 427/261, 427/397

[56] References Cited

U.S. PATENT DOCUMENTS 4,354,851 10/1982 Hix et al. .
4,395,263 7/1983 Davis .
4,758,952 7/1988 Harris, Jr. et al. .
4,842,613 6/1989 Purser .
5,108,818 4/1992 Ebina et al. .
5,142,722 9/1992 Kolb .

*Primary Examiner*—Margaret Einsmann

[57] ABSTRACT

A process and a coating for applying images by sublimation printing disperse dyes onto wooden articles wherein the article is coated with the coating, a polyester base coat, which is applied with rollers and conventionally cured preferably with ultraviolet heat. A sublimation decal is transfer printed into the cured coating using a press having a heated platen and operated at a temperature from 250 to 350 degrees Fahrenheit and at a pressure from 40 to 50 psi for 80 to 100 seconds. The chemical composition of the coating enables the process to be practiced at significantly lower temperatures(around 200 degrees Fahrenheit) to achieve and image reproduction of unsurpassed quality.

11 Claims, 2 Drawing Sheets

SUBLIMATION PRINTING OF WOODEN ARTICLES

BACKGROUND OF THE INVENTION

1. Field of the Invention

The present invention relates generally to decorative laminate structures and more particularly to a process for applying images by sublimation printing to wooden articles such as furniture and decorative plaques.

2. Description of the Prior Art

This invention relates to the treatment of various wooden surfaces so that they may be decorated by a sublimation printing process. Such printing processes involve, as a first step, full color lithographic printing on paper using "dispersal" dyes having the property of subliming or vaporizing to a gas when heated. A second step involves transferring the printed image under heat and, usually under pressure, in a transfer press to a substrate formed of material which is receptive to the sublimable ink. The inks are capable of being printed onto the paper by lithographic printing methods using etched gravure press cylinders and standard lithographic paper, so that one can obtain the high quality and full color reproduction achievable by these techniques.

Sublimation transfer processes have been found to be particularly useful in printing full color reproductions onto polyester fabric. Excellent color quality and efficient transfer is possible with such fabrics, but poor results are usually obtained on non-textile items such as wood, particle board, plastic sheets, leather, rubber and other organic or natural materials.

More recent advances have been made in printing non-textile items such as wood by first painting the wooden components with a base coat to obtain a background color. Thereafter the desired image is silk screened over the base color. Often complex images require six or more colors thus requiring that the board be handled each time a separate color is applied making tight registration difficult. After all colors have been applied, the wooden article is returned to the paint line for the application of a clear topcoat.

U.S. Pat. No. 4,395,263 issued to Davis, discloses a method for producing a laminate bearing a permanently visible pattern. The laminate comprises a binder layer containing pigment and a transparent layer, each layer being formed for a synthetic polymer such as polyester. Sublimable dyestuff is heat treated from an auxiliary web to the transparent layer to submerge the pattern into an external surface of the transparent layer.

U.S. Pat. No. 4,758,952 issued to Harris, Jr. et al, discloses a method for computerized transfer printing into a substrate. Various substrates may be employed including paper, wood, plastic, natural cloth, synthetic cloth, carpet material, concrete, glass, metal, such as steel, porcelain, and ceramic.

U.S. Pat. No. 4,842,613 issued to Purser discloses a process for heat transfer printing a pattern of disperse dyes onto a non-metallic inorganic surface such as glass or ceramic.

U.S. Pat. No. 5,142,722 issued to Kolb discloses a process for applying images by transfer printing disperse dyes onto furniture components especially for those used in juvenile furniture. A pigmented polyester base coat is coated and cured over the wood component and a sublimation decal is transfer printed onto the polyester coating at a temperature of around four hundred degrees Fahrenheit.

While the quality of printing on wooden articles has improved, there is a need for further refinement so that higher quality printed wooden surfaces are obtainable and more efficient and less costly printing is accomplished. Thus, there remains the need for a new and improved process for applying images by transfer printing to furniture articles, especially end pieces for use in specialized furniture, which is simple and economical to use.

SUMMARY OF THE INVENTION

The present invention is directed to a process for applying a disperse dye printed pattern to a wooden substrate by the use of a unique combination of known and new ingredients to achieve sublimation printing at temperatures around 200 degrees Fahrenheit. An organic polymeric coating is applied to one surface of a substrate and thereafter cured by heating. A carrier sheet containing a sublimable dye pattern is applied to the carrier sheet under pressure and heated to achieve an operable temperature of around 200 degrees at a pressure of from forty to fifty psi for a period of time ranging from eighty to one hundred seconds. The coating solution to treat the wooden substrate includes a polyester resin of 70 weight percent and a specific combination of additional ingredients to enable low temperature curing and high quality printing.

From the foregoing summary, it can be seen that a primary objective of the present invention is to provide a process for sublimation printing onto wooden surfaces that will result in higher quality printed images than heretofore achievable.

Another objective of the present invention is to provide a process for sublimation printing onto wooden components at a much lower temperature than heretofore has been achievable.

Yet still another objective of the present invention is to provide a process for printing sublimation images onto wooden surfaces that will not blur or fade and that will remain a permanent part of the design of the wooden component.

Thus there has been outlined in summary form the more important features of the invention in order that the detailed description that follows may be better understood and in order that the present contribution to the art may be better appreciated. There are, obviously, additional features to the invention that will be described hereinafter and which will form the subject matter of the claims appended hereto. It is to be understood that the invention is not limited in its application to the details of construction and to the arrangement of the components set forth in the following description and illustrated in the drawings. The invention is capable of other embodiments and of being practiced and carried out in various ways.

It is also to be understood that the phraseology and terminology used herein are for the purpose of description and should not be regarded as limiting in any respect. Those skilled in the art will appreciate the concept upon which this disclosure is based and that it may readily be utilized as a basis for designing other structures, methods and systems for carrying out the several purposes of the invention. It is also to be understood that the abstract is neither intended to define the invention or the application which is measured by the claims nor to limit its scope in any way.

This summary and these objectives of the invention, along with various features of novelty which characterize the invention are pointed out with particularity in the claims annexed to and forming a part of this disclosure. For a better understanding of the invention, its operating advantages and specific objectives obtained by its use, reference should be made to the accompanying drawings and descriptive matter in which like character or reference designated like parts throughout the several views.

DESCRIPTION OF THE PREFERRED EMBODIMENT

Figure 1:
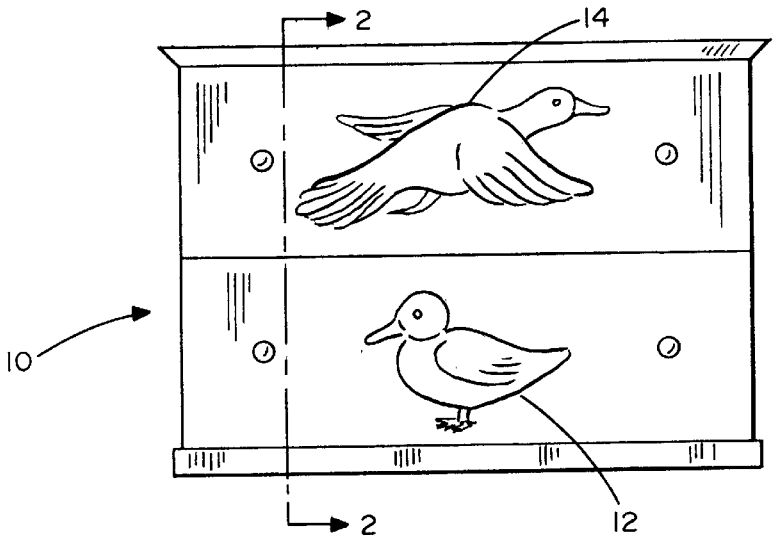
FIG. 1 is front elevational view of a wooden furniture component decorated with a pattern made in accordance with the present invention.

Referring now to FIG. 1, there is shown a front elevational view of an article of furniture in the form of a chest 10 treated with decorative patterns 12, 14.

Figure 2:
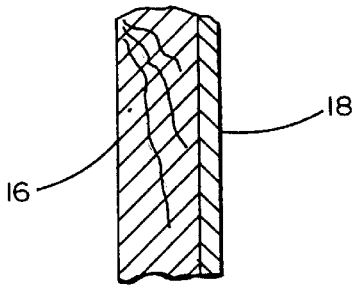
FIG. 2 is an enlarged sectional view of the decorated component shown in FIG. 1 taken along line 2—2.
Figure 3:
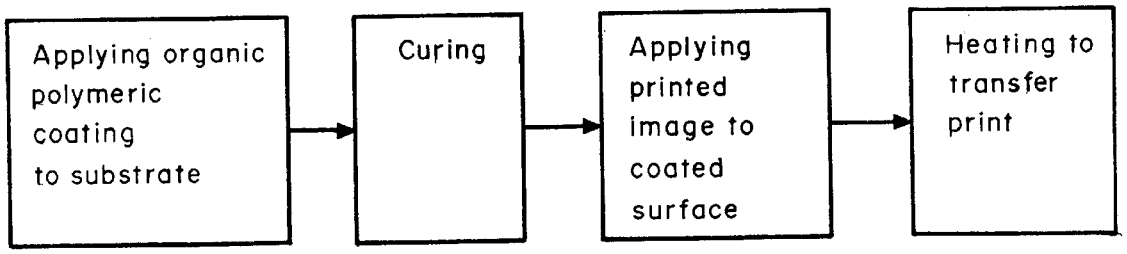
FIG. 3 is a block diagram of the process of preparing the surface of the wooden article shown in FIG. 1.

In the enlarged cross-sectional view of chest 10 shown in FIG. 2, taken along lines 2—2, a wooden substrate of plywood 16 is coated with a single layer of polyester or cross-lined acrylic coating 18. One particularly suitable coating is an ultraviolet cure coating applied by a direct roller coater ("UV-DRC"). Coating 18 can be applied by any conventional means including rollers or spray and cured either conventionally or by UV radiation.

The heat transfer sheet having the printed design is generally conventional in design. The sublimable dyestuffs printed on the paper include any dyestuffs known for that purpose such as disperse dyestuffs which pass into the vapor state under heat and pressure conditions. In this regard, suitable dyestuffs are referred to in U.S. Pat. No. 3,813,218 to deplasse, the disclosure of which is incorporated herein by reference. The dyestuffs may be printed on heat transfer paper either by conventional or offset printing techniques.

Figure 4:
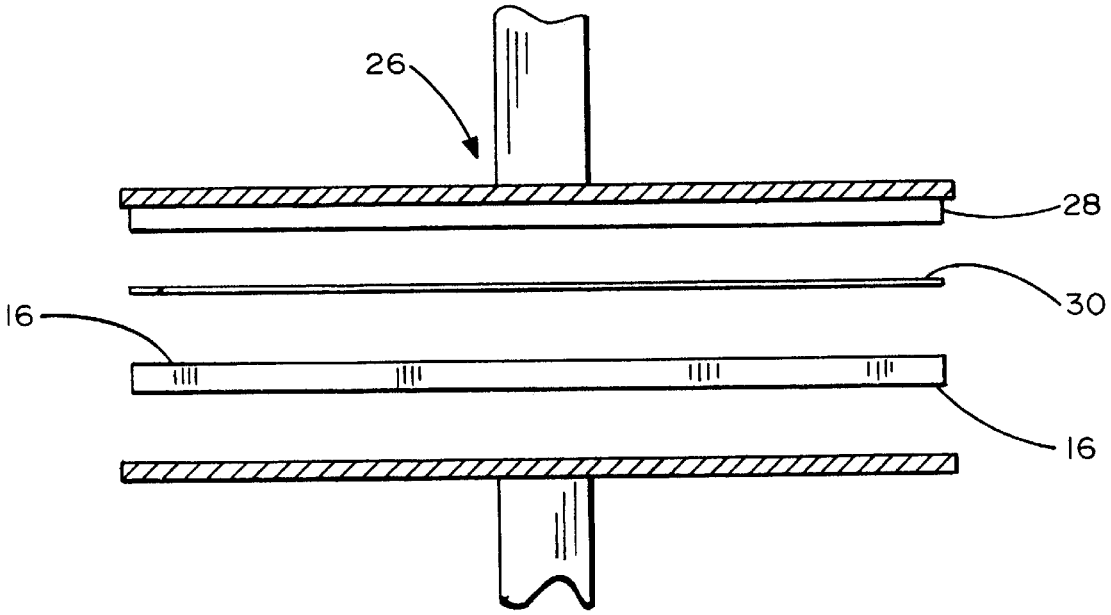
FIG. 4 is side elevational view of a portion of a printing apparatus used to practice the process of the present invention.

A schematic view of an apparatus suitable for carrying out the described process is shown in FIG. 4 and designated generally as 26. It includes a moveable platen 28 against which the carried decal 30 and furnished component 16 are heated and pressure bonded. One such press which has been used for this purpose is a Practix Model #OK 450 single platen heat press operated at a constant pressure manufactured by Practix Manufacturing Company located in Acworth, Ga. The coated side of the wooden surface bearing the transfer is the only side heated by the press.

The composition of the UV-DRC coating is as follows:

| Ingredient | Weight Percent |
|---|---|
| Cellulose Acetate Butyrate | 0.61 |
| Tripropylene Glycol Diacrylate Esters | 21.47 |
| *Unsaturated Polyester Resin | 70 |
| Methyl Ethyl Ketone | 3.88 |
| 2-Hydroxy-2-Methyl-1-Phenyl-1-Propanone | 3.68 |
| Polyester Modified Dimethyl Polysiloxane Copolymer | 0.36 |
| *Unsaturated Polyester Resin | |
| Styrene | 25 |
| Polymer Base Trade Secret Registry #MWT00341 | 75 |

The coating solution set forth above is particularly adapted to achieve high quality, low temperature sublimation printing at a temperature of about 200 degrees Fahrenheit on wooden surfaces or wooden components. Other color or preservative coatings may be applied, however it is essential that the formula set forth herein be followed with particularity.

The organic polyester coating utilized in the present invention includes cellulose acetate butyrate, tripropylene gylcol diacrylate esters, methyl ethyl ketone hydroxy methyl phenyl propanone, and polyester modified dimethyl polysiloxane copolymer. In the present invention the polyester resin includes styrene, the polyester resin is unsaturated, and the unsaturated polyester resin weight percent is approximately 70. An ultraviolet light activator may be used to accelerate the curing of the organic polymersic coating.

The present invention has been shown and described herein in what is considered the most practical and preferred embodiment. It is recognized, however, that departure may be made therefrom within the scope of the invention. It is therefor not to be limited to the details disclosed herein but to be accorded a full scope of the claims so as to embrace any and all equivalents thereof.

What is claimed is:

1. A process for applying a disbursed dye printed pattern to a wooden substrate comprising the steps of: apply only an organic polymeric coating onto one surface of the substrate; curing the organic polymeric coating; applying a printed image to the organic polymeric coating by applying a carrier sheet containing sublimable dyes thereon; and heating the disbursed dyes on the carrier sheet under pressure to transfer the dyes onto the organic polymeric coating at a temperature of approximately 200 degrees Fahrenheit at from 40 to 50 psi for 80 to 100 seconds.

2. The process as claimed in claim 1 wherein the organic polymeric coating includes a polyester resin.

3. The process as claimed in claim 2 wherein the polyester resin is unsaturated.

4. The process as claimed in claim 2 wherein the organic polymeric coating includes cellulose acetate butyrate, tripropylene gylcol diacrylate esters, methyl ethyl ketone, hydroxy methyl phenyl, propanone, and polyester modified dimethyl polysiloxane copolymer.

5. The process as claimed in claim 3 herein the organic polymeric coating includes cellulose acetate butyrate, tripropylene glycol diacrylate esters, methyl ethyl ketone, hydroxy methyl phenyl, propanone, and polyester modified dimethyl polysiloxane copolymer.

6. The process as claimed in claim 2 wherein the polyester resin includes styrene.

7. The process as claimed in claim 3 wherein the polyester resin includes styrene.

8. The process as claimed in claim 1 wherein the organic polymeric coating is cured by ultraviolet light.

9. The process as claimed in claim 8 further comprising the step of applying an ultraviolet light activator to accelerate the curing of the organic polymeric coating.

10. The process as claimed in claim 8 wherein the organic polymeric coating includes a polyester resin and the polyester resin is unsaturated.

11. The process as claimed in claim 10 wherein the organic polymeric coating includes cellulose acetate butyrate, tripropylene glycol diacrylate esters, methyl ethyl ketone, hydroxy methyl phenyl, propanone, and polyester modified dimethyl polysiloxane copolymer.

* * * * *